US005150579A

United States Patent [19]

Hingst

[11] Patent Number: 5,150,579

[45] Date of Patent: Sep. 29, 1992

[54] TWO STAGE COOLER FOR COOLING AN OBJECT

[75] Inventor: Uwe Hingst, Oberteuringen, Fed. Rep. of Germany

[73] Assignee: Bodenseewerk Gerätetechnik GmbH, Fed. Rep. of Germany

[21] Appl. No.: 628,186

[22] Filed: Dec. 14, 1990

[30] Foreign Application Priority Data

Dec. 14, 1989 [DE] Fed. Rep. of Germany ..... 3941314

[51] Int. Cl.[5] ..... F25B 19/02; F25B 9/10; F25D 3/10; H01L 23/46

[52] U.S. Cl. ..... 62/51.2; 62/51.1

[58] Field of Search ..... 62/51.2, 51.1

[56] References Cited

U.S. PATENT DOCUMENTS

| | | | |
|---|---|---|---|
| 2,991,633 | 7/1961 | Simon | 62/51.2 |
| 3,095,711 | 7/1963 | Wurtz, Jr. | 62/51.2 |
| 3,256,712 | 6/1966 | Makowski | 62/51.2 |
| 3,353,371 | 11/1967 | Hammonds et al. | |
| 3,372,556 | 3/1968 | Waldman | |
| 3,401,533 | 9/1968 | Maybury | 62/51.2 |
| 3,415,078 | 12/1968 | Liston | 62/51.2 |
| 3,422,632 | 1/1969 | Currie et al. | 62/51.2 |
| 3,782,129 | 1/1974 | Peterson | |
| 4,831,846 | 5/1989 | Sungaila | |

FOREIGN PATENT DOCUMENTS

| | | |
|---|---|---|
| 0432583 | 6/1961 | European Pat. Off. |
| 0234644 | 9/1987 | European Pat. Off. |
| 0271989 | 6/1988 | European Pat. Off. |
| 1501715 | 10/1969 | Fed. Rep. of Germany |
| 1501106 | 2/1970 | Fed. Rep. of Germany |
| 1501263 | 3/1970 | Fed. Rep. of Germany |
| 3337194 | 4/1985 | Fed. Rep. of Germany |
| 3337195 | 4/1985 | Fed. Rep. of Germany |
| 3642683 | 6/1988 | Fed. Rep. of Germany |
| 2568357 | 1/1986 | France |
| 1168912 | 10/1969 | United Kingdom |
| 1238911 | 7/1971 | United Kingdom |
| 2119071 | 11/1983 | United Kingdom |

*Primary Examiner*—Henry A. Bennet
*Assistant Examiner*—Christopher B. Kilner
*Attorney, Agent, or Firm*—Lee, Mann, Smith, McWilliams, Sweeney & Ohlson

[57] ABSTRACT

A cooling apparatus for cooling a pivotable detector contains a first cooler which serves for cooling the detector and contains a depressurization outlet through which pressurized argon which has been precooled below its inversion point, is depressurized and thereby cooled. A second cooler is operated using pressurized methane and serves for precooling the pressurized argon. The second cooler constitutes a Joule-Thomson cooler containing a depressurization nozzle for depressurizing and thereby cooling the pressurized methane, and a countercurrent heat exchanger arranged upstream of the depressurization nozzle for precooling the infed pressurized methane by the depressurized and cooled methane. The first cooler constitutes an expansion cooler containing a depressurization outlet and a heat exchanger upstream of the depressurization outlet for exclusive heat exchange between the pressurized argon and the depressurized and cooled methane. The argon exiting from the depressurization outlet of the first coolder, is depressurized and cooled down to its boiling point and directed toward the object to be cooled.

10 Claims, 3 Drawing Sheets

TWO STAGE COOLER FOR COOLING AN OBJECT

BACKGROUND OF THE INVENTION

The present invention relates to a new and improved construction of a cooling apparatus for cooling an object.

In its more particular aspects the present invention specifically relates to a new and improved construction of a cooling apparatus for cooling an object and which cooling apparatus contains a first cooler having an expansion or depressurization outlet. A pressurized first gas which is procooled below its inversion temperature, is passed through the expansion or depressurization outlet and is thereby depressurized with cooling. The cooling apparatus further contains a second cooler which is operated using a second gas for precooling the first gas.

For the purpose of clarification and definition of terms in the instant applications, the following is specifically noted: An expansion cooler is understood to define a cooler which operates by expanding or depressurizing a precooled pressurized gas in order to utilize the Joule-Thomson effect for further cooling down the gas. This gas is, then, employed for cooling an object. A Joule-Thomson cooler is understood to likewise define a cooler which operates by expanding or depressurizing a precooled pressurized gas for further cooling down the gas. This gas is, then, returned and passed through a return flow path of a heat exchanger for precooling the pressurized gas passing through a forward flow path of such heat exchanger.

In a cooling apparatus such as known, for example, from British Patent No. 1,238,911, cooling of a pressurized gas is achieved by expansion or depressurization effected by passing the gas through a nozzle. For this purpose, the gas must have a temperature below its inversion temperature prior to expansion or depressurization. The cooling apparatus according to British Patent No. 1,238,911 is provided with two coolers. In a first one of the two coolers a first gas is conducted in the gaseous state from a source of pressurized gas along a first path of a countercurrent heat exchanger, expansion or depressurized by passage through the nozzle and returned along a second path of the heat exchanger in counter-current fashion. As a result, the forward flowing pressurized gas is cooled. A second one of the two coolers causes the first to be precooled prior to arrival at the countercurrent heat exchanger of the first cooler. In this arrangement, a pressurized liquid is fed to the second cooler and sprayed into a chamber through a nozzle. During this operation, the liquid evaporates whereby the cooling action of the second cooler is achieved. The first cooler in this arrangement cools an object in the form of an infrared detector.

In German Published Patent Application No. 3,642,683, published Jun. 16, 1988, which is cognate with U.S. Pat. No. 4,819,451, granted Apr. 11, 1989, there is described a cryostat which is based on the Joule-Thomson effect and serves for cooling an infrared detector. A countercurrent heat exchanger including a forward flow line or conduit, is located in a Dewar vessel. The forward flow line or conduit terminates in an expansion or depressurization nozzle. The infrared detector is located at an end wall of the inner side of the Dewar vessel. A heat insulating layer is disposed between a base and the Dewar vessel for reducing the heat load. An inlet end of forward flow the line or conduit is cooled by Peltier elements in order to improve upon the cooling power achievable by such Joule-Thomson process at a given mass flow of pressurized gas.

German Published Patent Application No. 1,501,715, published on Oct. 30, 1969, relates to gas liquefying apparatus containing two expansion coolers operated by respectively using hydrogen and air or nitrogen. Both of the expansion coolers are constructed in the manner of Joule-Thomson coolers, i.e. contain respective countercurrent heat exchangers in which the respective expanded or depressurized and cooled gas is subject to heat exchange with the forward flowing gas. The liquid nitrogen or air obtained by a second one of the two Joule-Thomson coolers serves for precooling hydrogen in the first one of the two Joule-Thomson coolers. The hydrogen is thereby cooled down below its inversion temperature. However, nitrogen can be cooled by the respective Joule-Thomson cooler only down to its boiling point.

A similar arrangement is shown in German Published Patent Application No. 1,501,106, published on Jan. 8, 1970.

European Published Patent Application No. 0,271,989,published on Jun. 22, 1988, describes a conventional single-stage Joule-Thomson cooler using a coolant in the form of a mixture of nitrogen, argon and neon and methane, ethane or propane with the addition of a combustion inhibiting material like bromotrifluoromethane.

German Published Patent Applications No. 3,337,194 and 3,337,195, both published on Apr. 25, 1985, British Published Patent Application No. 2,119,071, published on Nov. 9, 1983, and European Published Patent Application No. 0,234,644 are all concerned with the use of a single-stage Joule-Thomson cooler for cooling electronic or opto-electronic components.

In copending U.S. patent application Ser. No. 07/563,433, filed on Aug. 7, 1990, there is proposed for gyro-stabilized seekers containing a planar image resolving detector, arranging the seeker on a support. The support is aligned to the gyro rotor and thus to the optical axis of the imaging optical system so that the plane of the planar detector is constantly oriented perpendicular to this optical axis even in the event of seeker "squint". In this arrangement there exists the problem of detector cooling. When using conventional Joule-Thomson coolers for cooling such detectors, there is provided a countercurrent heat exchanger through which expanded or depressurized and cooled gas is returned for precooling the incoming gas flow. During this operation, the expanded or depressurized gas should be utilized as completely as possible for the precooling process and gas losses as well as heat losses must be avoided. This can be achieved if the detector is stationarily arranged in a Dewar vessel. Difficulties result, however, when the detector is arranged at a movable support.

SUMMARY OF THE INVENTION

Therefore, with the forgoing in mind it is a primary object of the present invention to provide a new and improved construction of a cooling apparatus for cooling an object and which cooling apparatus is not afflicted with the drawbacks and limitations of the prior art constructions heretofore discussed.

Another and more specific object of the present invention is directed to the provision of a new and improved construction of a cooling apparatus for cooling an object and which cooling apparatus does not require arranging the object stationary in a Dewar vessel.

It is a further quite important object of the invention to provide a new and improved construction of a cooling apparatus for cooling an object, particularly a linear, i.e. a flat or planar detector in a gyro-stabilized seeker, and in which apparatus the detector can be aligned to the optical axis of the optical system in the condition of "squint".

Now in order to implement these and still further objects of the invention, which will be become more readily apparent as the description proceeds, the cooling apparatus of the present development is manifested by the features that, among other things, the second cooler is a Joule-Thomson cooler containing an expansion or depressurization outlet or nozzle through which the pressurized second gas is expanded or depressurized with cooling. This Joule-Thomson cooler further contains a countercurrent heat exchanger which precedes the expansion or depressurization outlet or nozzle and which enables precooling the infed pressurized second gas by the expanded or depressurized and cooled second gas. The first cooler constitutes an expansion cooler containing an expansion or depressurization outlet and a heat exchanger which precedes the expansion or depressurization outlet and wherein the pressurized first gas is in heat exchange only with the expanded or depressurized and cooled second gas. The expanded or depressurized and cooled first gas effluxing from the expansion or depressurization outlet of the first cooler, is directed toward the object to be cooled.

In the inventive arrangement, the gas which is cooled by means of the first cooler, is precooled exclusively by means of the second cooler. There can thus be selected for the second cooler a second gas which provides a strong cooling action but may have a boiling point which is too high for cooling the detector. The first cooler is operated using a first gas which has a low boiling point and which is directed, after expansion or depressurization and cooling, only to the object to be cooled and the environment thereof. The first gas, therefore, is not required to perform a precooling function. It can be shown that the total consumption of the first and second gas necessary for realizing a predetermined cooling power is not or only insubstantially greater than the gas consumption in a single Joule-Thomson cooler.

Advantageously argon is selected as the first gas. The second gas may be, for example, methane which produces good cooling power in a Joule-Thomson cooler. In relation to weight, the cooling power of methane is approximately five times the cooling power achievable when using argon, however, methane has a relatively high boiling point of 118K. The second gas may also be Freon, i.e. tetrafluoromethane. Freon also provides high cooling power at a boiling point of 145K at atmospheric pressure.

The object may be pivotably arranged relative to the expansion or depressurization outlet of the first cooler and preferably constitutes an infrared detector of a seeker.

An advantageous construction of the inventive cooling apparatus contains a shell which is closed at an end on the side of the object. The heat exchanger of the first cooler is arranged within the closed shell on the side of the object. The countercurrent heat exchanger of the second cooler is disposed within the closed shell on a side of the heat exchanger of the first cooler and which side is remote from the object. The countercurrent heat exchanger defines an outlet end from which a line or conduit conducting the second gas, extends through the heat exchanger of the first cooler. This line or conduit terminates intermediate the last mentioned heat exchanger and the closed end of the shell in the expansion or depressurization opening our outlet of the second cooler. A further line or conduit conducting the first gas, originates from the outlet end of the heat exchanger of the first cooler, is passed through the closed end of the shell and terminates in the expansion or depressurization outlet of the first cooler.

In this arrangement the shell may have a smaller diameter in the regioon of the heat exchanger of the first cooler as compared to the region of the countercurrent heat exchanger of the second cooler.

The line or conduit leading from the heat exchanger of the first cooler to the expansion or depressurization outlet of the first cooler may extend to the object in a heat insulated manner.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

DETAILED DESCRIPTION OF THE PREFERRED EMBODIMENTS

Figure 1:
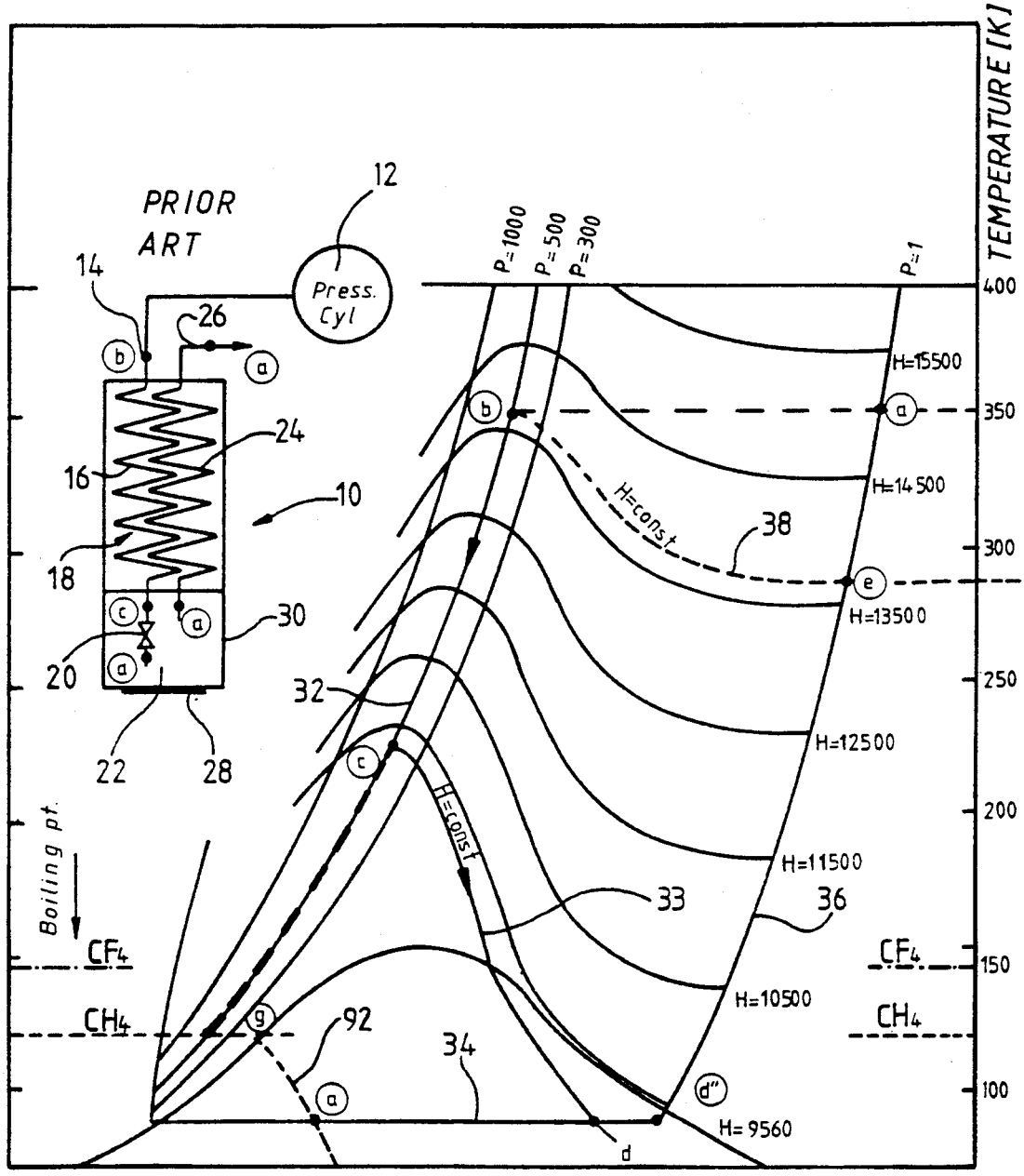
FIG. 1 is a schematic illustration of a conventional Joule-Thomson cooler in conjunction with a temperature entropy diagram of argon for explaining the basic concept of the invention.

Describing now the drawings, it is to be understood that only enough of the construction of the cooling apparatus has been shown as needed for those skilled in the art to readily understand the underlying principles and concepts of the present development, while simplifying the showing of the drawings. Turning attention now specifically to FIG. 1 of the drawings, and particularly for explaining the operative action of the Joule-Thomson effect, there is schematically shown therein a conventional Joule-Thomson cooler 10. A pressurized gas like, for example, argon flows from a pressure cylinder 12 through an inlet 14 into the forward flow path 16 of a countercurrent heat exchanger 18. The pressurized gas effluxes or exits through a restrictor or nozzle 20 into an expansion or depressurization space or chamber 22 and thereby is cooled. From the expansion space 22, the extended or depressurized and cooled gas flows back through a return flow path 24 of the countercurrent heat exchanger 18 and is discharged at an outlet 26. The inflowing pressurized gas is thereby precooled by the return gas flow in the countercurrent heat exchanger 18.

An infrared detector 12 designated by the reference character 28 is intended to be cooled by the Joule-Thomson cooler 10. The infrared detector 28 is located at the inner wall 30 of a not illustrated Dewar vessel surrounding the Joule-Thomson cooler 10.

The operation or process can be explained with reference to the temperature-entropy diagram shown in FIG. 1. In this diagram, the state or condition existing at various locations in the Joule-Thomson cooler 10 are identified by the letters "a" to "g". The associated locations are correspondingly marked in the schematic illustration of the Joule-Thomson cooler 10.

At the inlet 14 the pressurized gas has a temperature of about 350 K. at a pressure of about 500 bar. This is indicated at point "b" of the diagram. The pressure remains substantially constant along the forward flow path 16 of the countercurrent heat exchanger 18, however, the temperature drops due to precooling by the return gas flow. Consequently, the state or condition changes toward the state or condition "c" prevailing spatially immediately upstream of the nozzle 20 along a curve 32 of constant pressure. Expansion or depressurization of the gas is effected by the nozzle 20. As a result, the state or condition changes along a curve 33 of constant enthalpy in the diagram to a point "d". This point "d" is located on a straight line 34 associated with the saturated condition. In this state or condition the gas is partially condensed and a mixture of gas and liquid is formed. The temperature remains constant.

The gas assumes a state or condition "d" when entering the return flow path 24 of the countercurrent heat exchanger 18. Along this return flow path 24, the expanded or depressurized and cooled gas is reheated due to heat exchange with the pressurized gas flowing through the forward flow path 16. This reheating process is effected at atmospheric pressure, i.e. a pressure of P=1 bar. Thus the state or condition changes along a constant pressure curve 36 toward a point "a". At this point "a", there exists again the aforementioned temperature of about 350 K. which may constitute the environmental temperature at the respective location.

The cooling power is defined by the difference of the enthalpies existing at the points "a" and "b". The enthalpy at the point "b" is substantially equal to the enthalpy at a point "e". This point "e" constitutes the point of intersection between the constant pressure curve 36 and a constant enthalpy curve 38 which extends through the point "b". In comparison with the enthalpies which are exchanged in the countercurrent heat exchanger 18, the difference in the enthalpies at the points "a" and "e" is quite small.

Figure 2:
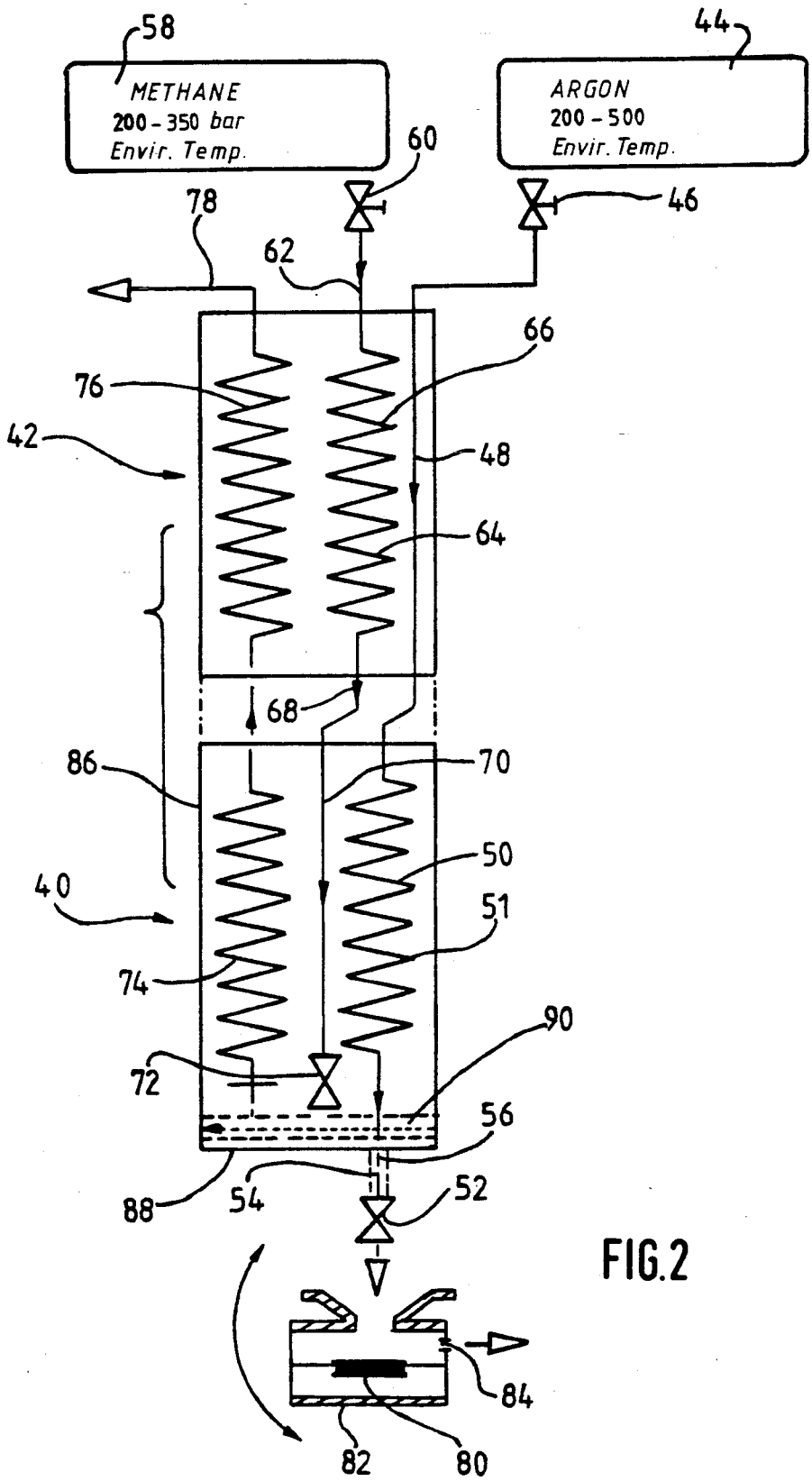
FIG. 2 is a schematic illustration of an exemplary embodiment of the inventive cooling apparatus containing a second cooler exclusively for precooling the gas present in a first Joule-Thomson cooler.

Turning now to FIG. 2 of the drawings, there is shown therein as a matter of example and not limitation, an exemplary embodiment of the inventive cooling apparatus in a schematic illustration. This cooling apparatus contains a first cooler 40 and a second cooler 42.

The first cooler 40 is operated using a first gas such as, for example, argon which is obtained from a first pressure reservior or tank 44 containing pressurized argon. The argon is present in the first pressure reservoir or tank 44 at a temperature corresponding to the environmental temperature prevailing in the environment of the first pressure reservior or tank 44. In the event that the cooling apparatus is installed in, for example, a seeker, such temperature may be at or above room temperature and may well reach 350 K. In the illustrated example the pressure prevailing in the first pressure reservior or tank 44 is in the range of 200 to 500 bar.

The pressurized argon is passed through a forward flow path 50 of a heat exchanger 51 of the first cooler 40 via a valve 46 and a line or conduit 48 which runs substantially straight through the second cooler 42. The first cooler 40 constitutes an expansion cooler containing a restrictor or throttle 52 which constitutes an expansion or depressurization outlet and which is connected to an outlet of the forward flow path 50 by means of a high-pressure line or conduit 54. This high-pressure line or conduit 54 is provided with heat insulation 56.

The second cooler 42 is operated using a second gas such as, for example, methane which is obtained from a second pressure reservoir or tank 58. The methane is present in the second pressure reservoir or tank 58 at a temperature which corresponds to the temperature prevailing in the environment of the second pressure reservoir or tank 58 and may be substantially the same as the aforementioned environmental temperature of the first or argon pressure reservoir or tank 44. In the illustrated example, the pressure prevailing in the second pressure reservoir or tank 58 is in the range of 200 to 350 bar.

The pressurized methane is passed through a valve 60 to an inlet 62 of a forward flow path 64 of a countercurrent heat exchanger 66 of the second cooler 42. A line or conduit 70 extends from an outlet 68 of the forward flow path 64 of the countercurrent heat exchanger 66 and runs substantially straight through the first cooler 40 to an expansion or depressurization nozzle or outlet constituting a restrictor or throttle 72. The restrictor or throttle 72 is located in the first cooler 40 at an end which is remote from the second cooler 42.

The pressurized methane effluxes or exists from the restrictor or throttle 72 which acts like an expansion or depressurization valve so that the effluxing methane is expanded or depressurized and thereby cooled. The depressurized and cooled methane, then, flows through a return flow path 74 of the heat exchanger 51 in the first cooler 40 in countercurrent fashion with respect to the pressurized argon passing through the forward flow path 51 of the first cooler 40. As a result, the pressurized argon is precooled in the first cooler 40 under the action of the expanded or depressurized and cooled methane which is in the state or condition of a saturated vapor. The pressurized argon, however, is not precooled by depressurized argon as would be the case in the conventional Joule-Thomson cooler.

Thereafter, the expanded or depressurized methane flows through a return flow path 76 of the countercurrent heat exchanger 66 in the second cooler 42. Therein the pressurized methane which flows through the forward flow path 64, is precooled under the action of the expanded or depressurized and still cooled methane. The expanded or depressurized and cooled methane effluxes or exits from an outlet 78 of the return flow path 76.

The precooled argon which effluxes or exits from the forward flow path 50 of the heat exchanger 51 of the first cooler 40 through the restrictor or throttle 52, forms a jet directed toward an infrared detector 80 arranged at a movable carrier or support 82. The argon, then, leaves the carrier or support 82 through an aperture 84.

The first cooler 40 and the second cooler 42 are enclosed into a jacket or shell 86 defining an end wall 88 on the side of the object, i.e. the infrared detector 80 in the illustrated example. The heat-insulated high-pressure line or conduit 54 is passed through this end wall 88.

The mode of operation of the aforedescribed cooling apparatus will now be described as follows with reference again to FIG. 1 of the drawings:

The pressurized methane is cooled down to the boiling point of methane under the action of the second cooler 42 and the restrictor or throttle 72 due to a Joule-Thomson process. As already mentioned hereinabove, methane provides a significantly higher cooling power in comparison with argon. However, temperatures below the methane boiling point of 118 K. can not be obtained. Liquid methane thus accumulates in the jacket or shell 86 as indicated by reference character 90.

As a result of heat exchange with the expanded or depressurized and cooled methane which is in the saturated vapor state or condition, the pressurized argon is precooled in the heat exchanger 51 of the first cooler 40 down to the boiling point of methane. Consequently, the state or condition of the pressurized argon changes along the constant pressure curve 32 down to the point "f". As a result of the expansion or depressurization of argon at the restrictor or throttle 52, its state or condition is further changed along a constant enthalpy curve 92 to the point "g" which is also located on the straight line 34 associated with the saturated state or condition. This has the affect that there effluxes or exits at the restrictor or throttle 52 a jet comprising a mixture of gaseous and liquid argon having temperature of 87 K. which is the boiling point of argon.

This argon, in contrast with the conventional Joule-Thomson cooling process, is not required for precooling the incoming and forwardly flowing pressurized argon which flows through the forward flow path 50 of the heat exchanger 51 in the first cooler 40. In fact, the liquid argon is vaporized and, as a consequence, the state or condition of the argon changes along the striaght line or saturated vapor line 34 to point "d" whereafter the argon is heated up.

The object such as, for example, the infrared detector 80 is cooled by the aforementioned argon jet of 87 K. When this object has been cooled down to 87 K., the argon can no longer absorb heat therefrom. Then, such still very cold argon can further utilized for cooling down the environment of the object the infrared detector 80 as well as lines or conductors leading thereto in order to thereby reduce heat supply to the object or infrared detector 80.

As already explained hereinbefore, the cooling power is defined by an enthalpy difference, in the illustrated example by the difference of the enthalpies at the points "g" and "d". This enthalpy difference in the inventive cooling apparatus is greater by a factor of substantially 2.5 as compared to the enthalpy difference which can be realized in the argon-operated conventional Joule-Thomson cooler 10 as described hereinbefore in connection with FIG. 1 Such higher cooling power permits reducing the gas flows in the inventive cooling apparatus. As a consequence, this has the highly benificial effect that notwithstanding the additionally required methane flow the required total amount of gas can be the same or even lower than the amount necessary for a conventional argon-operated cooling apparatus. Also, in the process carried out in the inventive cooling apparatus the gases do not need to be pressurized to extremely high pressures.

Instead of methane, tetrafluoromethane $CF_4$ may also be used as the second gas or cooling gas. As indicated in FIG. 1, its boiling point is somewhat higher, namely 145 K.

Figure 3:
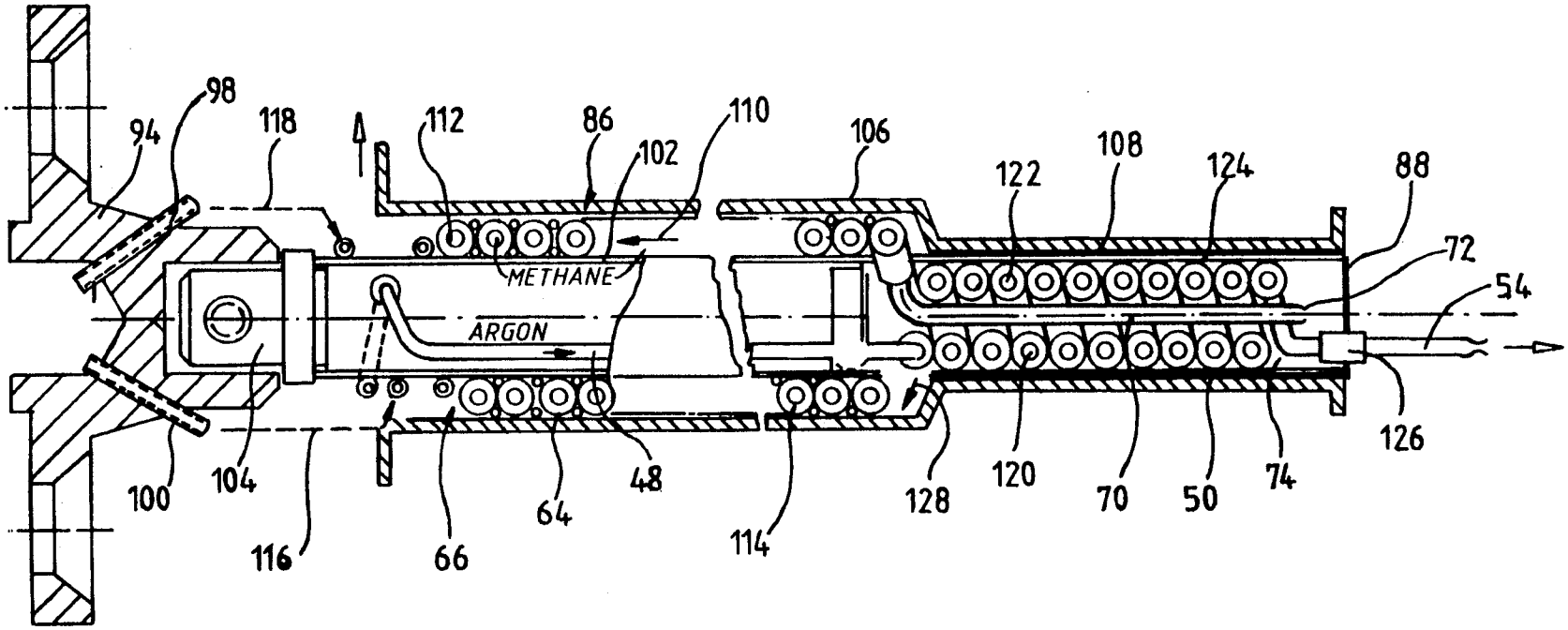
FIG. 3 is a longitudinal section through a construction containing the cooling apparatus shown in FIG. 2.

FIG. 3 shows a construction embodying a cooling apparatus which is essentially of the type as schematically illustrated in FIG. 2 and wherein corresponding elements are designated by the same reference characters.

A base 94 can be mounted at a supporting structure by means of a mounting flange 96. Pipes or conduits 98 and 100 for argon and methane, respectively, are passed through the base 96 and extend from the respective pressure reservoirs or tanks 44 and 58 to the respective first and second coolers 40 and 42. A sleeve 102 contains a base or base member 104 which is retained at the base 94. The sleeve 102 is coaxially positioned within the jacket or shell 86 which may form the inner wall of a Dewar vessel or constitute part of a simple heat-insulating housing. The jacket or shell 86 has an open end formed by a section 106 of increased diameter, and a closed end which is closed by the end fawall 88 and formed by a section 108 of smaller diameter. An annular space 110 is defined between the jacket or shell section 106 and the sleeve 102.

The forward flow path 64 of the countercurrent heat exchanger 66 in the second cooler 42 is located within the annular space 110 and formed by a tube or pipe 112 which extends around the sleeve 102 in a helical or coiled manner. The tube or pipe 112 is provided with ribs for 114 for improving heat transfer. The return flow path 76 of the countercurrent heat exchanger 66 in the second cooler 42 is formed by the annular space 110. The expanded or depressurized methane flows off through this annular space 110.

The tube or pipe 112 terminates in the substantially straight line or conduit 70 which extends substantially centrally through the smaller diameter section 108 of the jacket or shell 86 and ends closely upstream of the end wall 88. At its end, the line or conduit 70 is formed with a nozzle constituting the restrictor or throttle 72, see also FIG. 2. The tube or pipe 112 is further connected to the methane pipe or conduit 100 as indicated in FIG. 3 by the broken line 116.

The argon pipe or conduit 98 is connected to the line or conduit 48 which runs substantially straight through the sleeve 102. This connection is indicated in FIG. 3 by the broken line 118.

The forward flow path 50 of argon in the heat exchanger 51 of the first cooler 40 is connected with the line or conduit 48 and is formed by a tube or pipe 120. This tube or pipe 120 is arranged around the substantially straight line or conduit 70 in a helical or coiled manner within the smaller diameter section 108 of the jacket or shell 86. The tube or pipe 120 likewise is provided with ribs 122 for improving heat transfer. A sleeve 124 is seated within the smaller diameter section 108, surrounds the coil formed by the tube or pipe 120 and is closed by the end wall 88. The tube or pipe 120 is sealingly passed through the end wall 88 by means of a seal 126 and merges with the heat-insulated high-pressure line of conduit 54. This high-pressure line or conduit 54 terminates in a nozzle which forms the restrictor or throttle 52, see also FIG. 2.

The return flow path 74 of the first cooler 40 is defined by the interior space of the sleeve 124. Expanded or depressurized and cooled methane flows therethrough and past the argon conducting tube or pipe 120 with which it is in heat exchange. As indicated by the arrow 128, the expanded or depressurized and cooled methane thereafter flows into the annular space 110 and then cools the tube or pipe 112 and the forward flowing methane passing therethrough.

During this operation, as already explained hereinbefore, the methane is present in a saturated state or condition, i.e. partially in the liquid state and partially in the gaseous state and at the methane boiling temperate, in the smaller diameter section 108 of the jacket or sleeve 86 and thus in the heat exchanger 51 of the first cooler 40. Upon transition from the smaller diameter section 108 into the annular space 110 of the greater diameter section 106, the methane is substantially completely present in the gaseous state.

While there are shown and described present preferred embodiments of the imvention, it is to be distinctly understood that the invention is not limited thereto, but may be otherwise variously embodied and practiced within the scope of the following claims.

What I claim is:

1. A cooling apparatus for cooling an object, comprising:

a first cooler constituting an expansion cooler for cooling the object;

said first cooler containing a depressurization outlet;

a first gas source containing a pressurized first gas and connected to said first cooler;

a second cooler for precooling said pressurized first gas to a temperature below a predetermined inversion temperature of said pressurized first gas;

said depressurization outlet of said first cooler depressurizing and thereby further cooling said precooled pressurized first gas;

said depressurization outlet of said first cooler being associated with said object and directing said depressurized and further cooled first gas toward said object for cooling said object;

said object to be cooled being arranged to vent said depressurized first gas after heat exchange of said first gas with said object;

said second cooler constituting a Joule-Thomson cooler containing a depressurization nozzle;

a second gas source containing a pressurized second gas and connected to said second cooler;

said depressurization nozzle of said second cooler depressurizing and thereby cooling said second gas;

said second cooler further containing a countercurrent heat exchanger disposed upstream of said depressurization nozzle of said second cooler;

said countercurrent heat exchanger of said second cooler precooling said pressurized second gas infed into said second cooler from said second gas source, by means of said depressurized and cooled second gas originating from said depressurization nozzle;

said first cooler further containing a heat exchanger disposed upstream of said depressurization outlet of said first cooler; and said heat exchanger of said first cooler receiving said pressurized first gas from said first gas source for heat exchange exclusively with said depressurized and cooled second gas originating from said depressurization nozzle of said second cooler in order to thereby precool said pressurized first gas to said temperature below said predetermined inversion temperature.

2. The cooling apparatus as defined in claim 1, wherein:

said first gas is argon.

3. The cooling apparatus as defined in claim 1, wherein:

said second gas is selected from methane and tetrafluoromethane.

4. The cooling apparatus as defined in claim 1, further including:

means for pivotably supporting said object relative to said depressurization outlet of said first cooler.

5. The cooling apparatus as defined in claim 1, wherein:

said object constitutes an infrared detector.

6. The cooling apparatus as defined in claim 1, further including:

a shell accommodating said first cooler and said second cooler;

said shell having a closed end on the side of said object;

said heat exchanger of said first cooler being arranged in said shell on the side of said object;

said countercurrent heat exchanger of said second cooler being arranged in said shell on a side of said heat exchanger of said first cooler and which side is remote from said object;

said countercurrent heat exchanger of said second cooler defining an end located on an outlet side of said countercurrent heat exchanger;

said countercurrent heat exchanger of said second cooler containing a conduit for conducting said pressurized second gas;

said conduit for conducting said pressurized second gas extending from said end located on the outlet side of said countercurrent heat exchanger through said heat exchanger of said first cooler and terminating in said depressurization nozzle of said second cooler intermediate said heat exchanger of said first cooler and said closed end of said shell;

said heat exchanger of said first cooler defining an end located on an outlet side of said first cooler;

said heat exchanger of said first cooler containing a conduit for conducting said pressurized first gas; and said conduit for conducting said pressurized first gas extending from said end located on the outlet side of said heat exchanger through said closed end of said shell and terminating in said depressurization outlet of said first cooler.

7. The cooling apparatus as defined in claim 6, wherein:

said shell has a predeterminate diameter; and said predeterminate diameter of said shell being smaller in the region of said heat exchanger of said first cooler as compared to a greater predeterminate diameter in the region of said countercurrent heat exchanger of said second cooler.

8. The cooling apparatus as defined in claim 7, further including:

a sleeve substantially concentrically arranged in said shell in a shell section having said greater predetermined diameter;

said shell having an open end;

said sleeve being closed on the side of said open end of said shell;

said sleeve defining an annular space conjointly with said shell section having said greater predeterminate diameter;

said countercurrent heat exchanger of said second cooler containing a helical tube which defines a forward flow path of said countercurrent heat exchanger for said pressurized second gas;

said helical tube being provided with ribs;

said helical tube being disposed around said sleeve in said annular space defined by said sleeve conjointly with said shell section having said greater predeterminate diameter;

said countercurrent heat exchanger of said second cooler defining a return flow path for said depressurized and cooled second gas; and said return flow path being formed by said annular space defined by said sleeve conjointly with said shell section having said greater predeterminate diameter.

9. The cooling apparatus as defined in claim 8, wherein:

said heat exchanger of said first cooler defines a forward flow path of said heat exchanger of said first cooler;

said forward flow path having an inlet side;

said conduit conducting said pressurized first gas in said heat exchanger of said first cooler constituting a substantially straight conduit leading to said inlet side of said forward flow path of said heat exchanger of said first cooler and extending inside said sleeve in said shell section having said greater predeterminate diameter;

said forward flow path of said heat exchanger of said first cooler constituting a helical tube provided with ribs;

said shell defining a shell section having said smaller predetermined diameter;

said helical tube being arranged in said shell section having said smaller predeterminate diameter;

said conduit for conducting said second pressurized gas in said countercurrent heat exchanger of said second cooler constituting a substantially straight tube which is substantially centrally passed through said helical tube;

said shell having an end wall at its closed end; and said substantially straight tube which is substantially centrally passed through said helical tube, having an end defining said depressurization nozzle and located closely upstream of said end wall of said shell.

10. The cooling apparatus as defined in claim 9, further including:

a heat-insulated high-pressure conduit passed through said end wall of said shell and leading to said object;

said helical tube having an outlet end;

said outlet end of said helical tube merging with said heat-insulated high-pressure conduit;

said heat-insulated high pressure conduit terminating in said depressurization outlet of said first cooler.

* * * * *